US005105802A

United States Patent [19]

Pokorny

[11] Patent Number: 5,105,802

[45] Date of Patent: Apr. 21, 1992

[54] DEVICE FOR WORKING A CONDITIONING SUBSTANCE ON A SURFACE

[75] Inventor: George Pokorny, Brampton, Canada

[73] Assignee: Leatherjet Inc., Rexdale, Canada

[21] Appl. No.: 548,405

[22] Filed: Jul. 5, 1990

[30] Foreign Application Priority Data

Apr. 6, 1990 [CA] Canada ..... 2014070

[51] Int. Cl.[5] ..... A61H 1/00

[52] U.S. Cl. ..... 128/67; 128/32; 128/44; 128/56; 128/61

[58] Field of Search ..... 128/32, 44, 45, 46, 128/56, 57, 60, 61, 67, 24.2

[56] References Cited

U.S. PATENT DOCUMENTS

| | | | |
|---|---|---|---|
| 589,506 | 9/1897 | Kimball . | |
| 856,680 | 6/1907 | Campbell . | |
| 1,715,747 | 6/1929 | Falek . | |
| 1,777,151 | 9/1930 | Rüttger et al. | 128/56 |
| 1,899,208 | 2/1933 | Murphy | 128/57 |
| 2,668,968 | 2/1954 | Dobrowolski | 15/28 |
| 3,733,634 | 5/1973 | Golbe | 15/28 |
| 3,994,290 | 11/1976 | Springer et al. | 128/57 |
| 4,326,508 | 4/1982 | Stauffer | 128/57 |
| 4,526,163 | 7/1985 | Fedders | 128/56 |
| 4,823,777 | 4/1989 | Goncalves et al. | 128/57 |
| 4,858,600 | 8/1989 | Gross et al. | 128/65 |
| 4,964,398 | 10/1990 | Jones | 128/56 X |

FOREIGN PATENT DOCUMENTS 3025555 2/1982 Fed. Rep. of Germany .

*Primary Examiner*—R. Hafer
*Assistant Examiner*—Brian E. Hanlon
*Attorney, Agent, or Firm*—Rogers, Bereskin & Parr

[57] ABSTRACT

A device for working a conditioning substance on a surface comprises a body portion containing an activatable motor. A head attached to the body portion has an outer head and a rotatable inner head. A drive shaft extends between the motor and the head, and is driven by the motor. The drive shaft has a first drive take off for imparting rotation to the inner head about a first central axis of rotation passing through the inner head. The drive shaft also has a second drive take off for imparting rotation to at least one massaging element about a second axis of rotation passing through the massaging element by frictionally engaging the massaging element, each massaging element being located within the inner head and extending past an outer surface thereof. When the motor is activated, each massaging element is simultaneously rotated in two manners, firstly, about the first central axis of rotation and secondly about the second axis of rotation, to work the surface upon the device being then applied.

14 Claims, 4 Drawing Sheets

DEVICE FOR WORKING A CONDITIONING SUBSTANCE ON A SURFACE

FIELD OF THE INVENTION

This invention relates to massaging devices, generally, and in particular relates to those devices intended for working a conditioning substance on a surface to be treated such as leather upholstery.

BACKGROUND OF THE INVENTION

Various massaging devices have been proposed in the past for massaging parts of the human body, and for the massaging or working of other various surfaces. Essentially, these massaging devices can be divided into two categories, namely, those that are manually operated and those that are motorized.

Such manually operated devices typically function as an applicator of a cosmetic or other conditioning substance onto a surface. Such devices usually comprise a reservoir, which can also serve as a handle for the device, and an applicator element, wherein the applicator element includes one or more rotatably mounted balls. Such devices make it possible, by manually moving the device along a surface, thereby causing said ball(s) to roll along the surface, to simultaneously massage a surface and apply a cosmetic or other substance thereto. Typical known arrangements are shown in U.S. Pat. No. 4,823,777 (Goncalves) issued Apr. 25, 1989, and U.S. Pat. No. 4,326,508 (Stauffer) issued Apr. 27, 1982.

In one of the typical versions of the motorized devices there usually is a chamber and ball-equipped plate comparable to that of the manually operated devices described above, except that an electric motor rotates the plate, causing the balls to roll along the surface. Such an arrangement is shown in U.S. Pat. No. 4,858,600 (Gross) issued Aug. 22, 1989. Other devices are used for example to finish steel surfaces and are sometimes referred to as "burnishing tools". In such devices the balls are merely placed between two surfaces that are moved relative to one another, causing the balls to travel over the surface thereof.

Another typical version of the motorized device is one where the electric motor rotates each massaging element, fitted with a brush, a sponge or other appropriate material, about an axis of rotation passing through said element, causing the massaging element to massage the surface by moving past the surface. Typical known arrangements are shown in U.S. Pat. No. 4,526,163 (Fedders) issued July 2, 1985, and U.S. Pat. No. 3,733,634 (Golbe) issued May 22, 1973.

The disadvantage of these prior art devices is that the massaging action tends to be inadequate for proper working of a surface because the rotatable balls are merely moved along the surface, and being free to rotate, do rotate. Thus, there is only point loading on the surface, but no working of the surface. Furthermore, the motorized devices may damage the surface being worked since they are stationary unless moved along by hand, and further because the rotating elements have an inadequate ability to slip.

What is therefore desired is to provide a device for adequately working a conditioning substance on a surface. Preferably such a device could mechanically emulate a manual hand kneading action upon such a surface.

SUMMARY OF THE PRESENT INVENTION

According to the present invention, a device for working a conditioning substance on a surface comprises:

a body portion containing an activatable drive means;

a head, attached to the body portion, the head having an outer head and a rotatable inner head;

a drive shaft extending between drive means and the head and driven by the drive means;

a first drive take off for imparting rotation to the inner head about a first central axis of rotation passing through the inner head; and a second drive take off for imparting rotation to at least one spherical massaging element about a second axis of rotation passing through the massaging element by frictionally engaging the massaging element, each massaging element being located within the inner head and extending past an outer surface thereof;

wherein when the drive means is activated, each massaging element is simultaneously rotated in two manners, firstly, about the first central axis of rotation and secondly about the second axis of rotation, to work said surface upon said device being then applied.

BRIEF DESCRIPTION OF THE DRAWING FIGURES

Embodiments of the invention will now be described, by way of example only, with reference to the accompanying drawings, wherein.

DESCRIPTION OF PREFERRED EMBODIMENT

Figure 1:
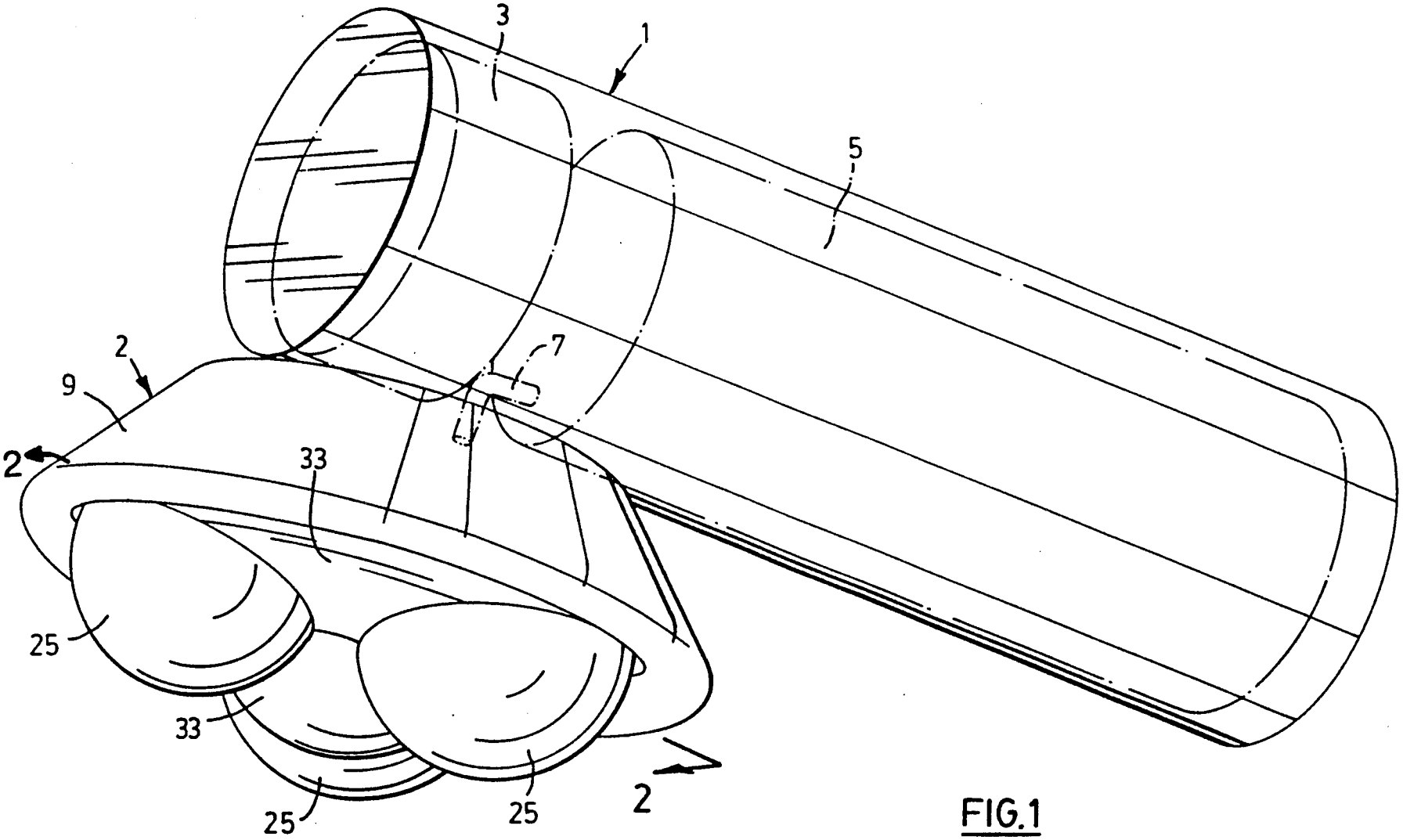
FIG. 1 is a perspective view of a device for working a surface showing one embodiment of the present invention.
Figure 2:
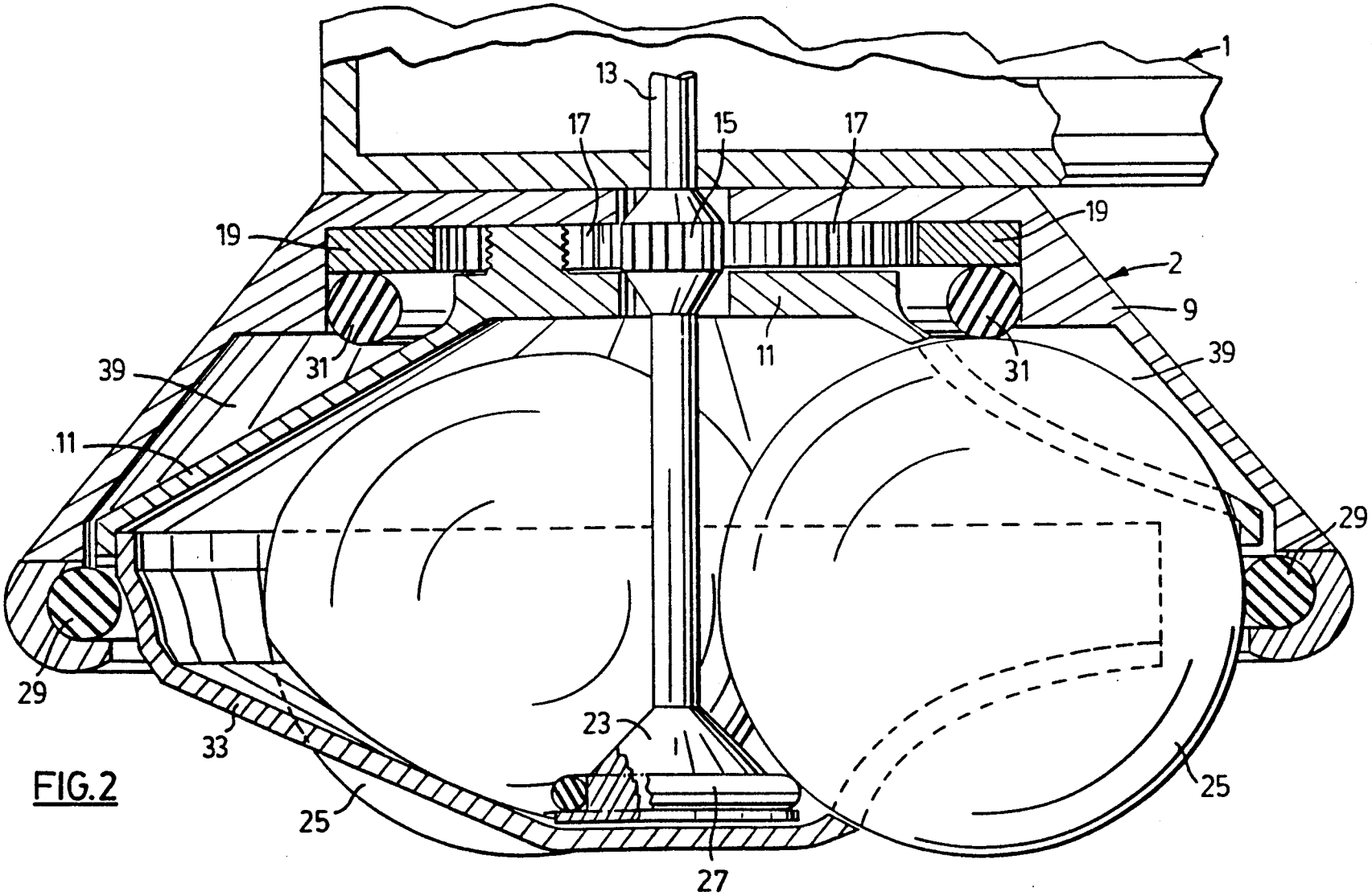
FIG. 2 is a cross-sectional view taken on the line 2—2 of FIG. 1.
Figure 3:
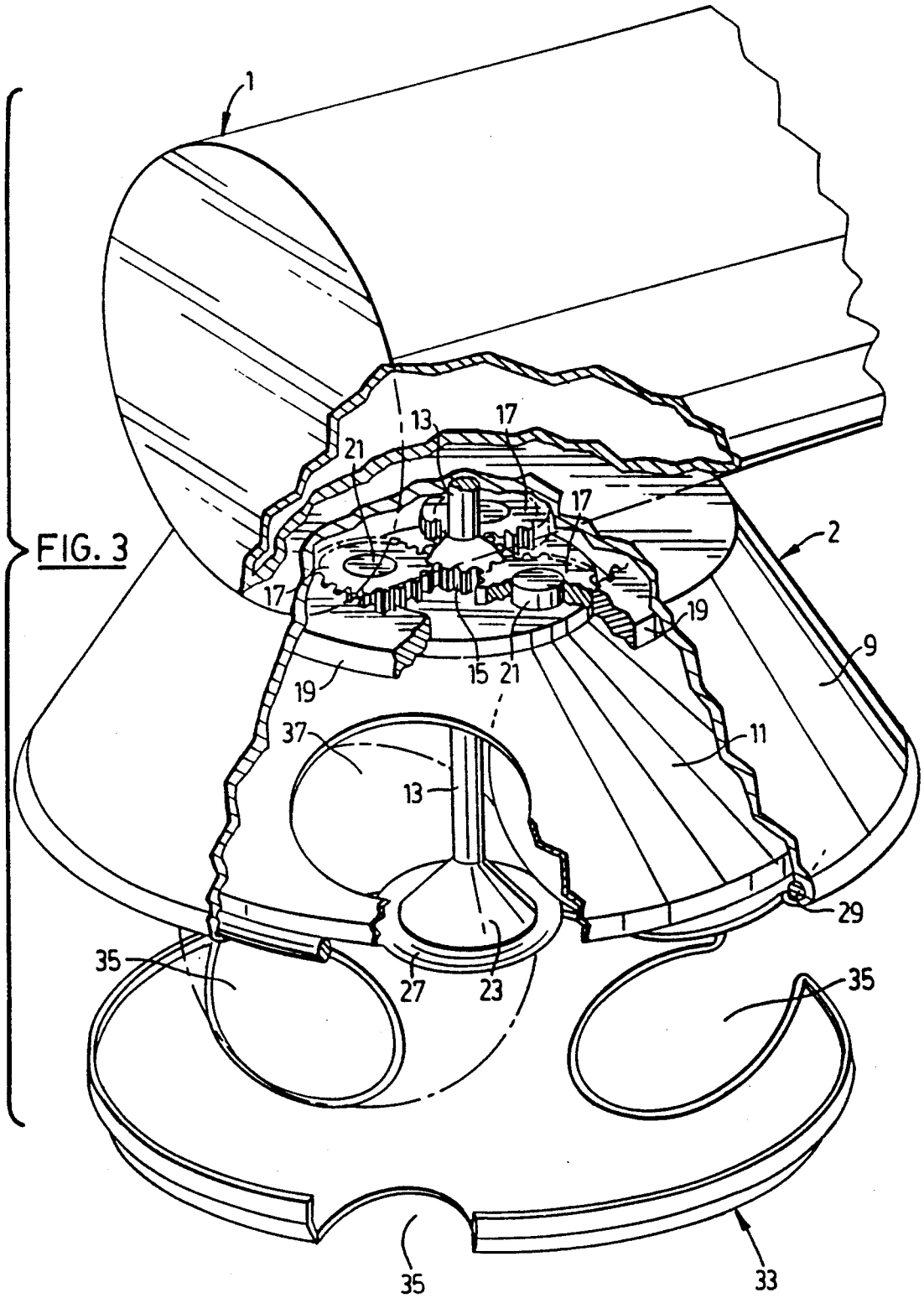
FIG. 3 is a fragmentary perspective view, on an enlarged scale, of a portion of the embodiment shown in FIG. 1.

FIGS. 1 to 3 show a device for working a conditioning substance on a surface, the device comprising a body portion 1 to which is attached a head 2. The body portion 1 contains an activatable drive means 3 which may be any electrical motor adequately powered to deliver the massaging action described herein. Also within the body portion 1 is a receptacle 5 adapted to accept a conditioning substance suitable for treatment of the surface to be worked. This conditioning substance is transported from the receptacle 5 to the head through a transfer conduit 7.

The body portion 1 preferably has a configuration such that it may be gripped by a single hand of a user.

A drive shaft 13 (FIG. 2) extends between the drive means 3 and the head 2, and is driven by the drive means 3. The drive shaft 13 projects through an outer portion of the head 2, namely through the outer head 9 which is attached to the body portion 1, and through a rotatable inner portion of the head 2, namely through the inner head 11, to a drive take off, hereinafter referred to as the second drive take off 23. It will be appreciated by those skilled in the art that the outer head 9 could be integrally formed as part of body portion 1, or could be later attached. Further, it would also be possible for the outer head 9 to rotate although this would be more difficult, and this is not preferred.

The drive shaft 13 has a first drive take off 15 for imparting rotation to the inner head 11 about the longitudinal axis of the drive shaft 13, hereinafter referred to as the first central axis of rotation. The first drive take off 15 makes a meshing engagement with three planet gears 17 which in turn are meshingly engaged with an outer gear ring 19. The outer gear ring 19 is mounted within the outer head 9 and is frictionally engaged thereto. Circular studs 21 are fixed to , or form an integral part of, the inner head 11, each of the circular studs 21 protruding into a central recess of each planet gear 17. In this manner the inner head 11 is rotationally coupled to the planet gears 17. It will be appreciated by those skilled in the art that while three planet gears 17 are shown in FIG. 3, a different number of planet gears 17 may be used.

This gearing mechanism associated with the first drive take off 15 serves to impart the rotational motion of the drive shaft 13 about the first central axis of rotation to the planet gears 17 which, by virtue of their aforementioned coupling with the inner head 11, cause said inner head 11 to rotate about the first central axis of rotation. When the rotating inner head 11 encounters a predetermined amount of resistance, slippage occurs at the interface between the outer gear ring 19 and the outer head 9, allowing the inner head 11 to slip as well. It will be appreciated by those skilled in the art that the amount of force required to cause slippage can be varied, and will be adjusted to suit the particular application. For example, for thick leather, as is common in upholstery, the setting would be relatively stiff, but still at a low enough force so that slippage would occur before the leather becomes damaged.

The second drive take off 23 is frictionally engaged with massaging elements 25. In the preferred embodiment of the invention illustrated in the drawings, the device includes a guide means 27, made of a resilient material such as hard rubber or plastic, fixed to the second drive take off 23.

Figure 4:
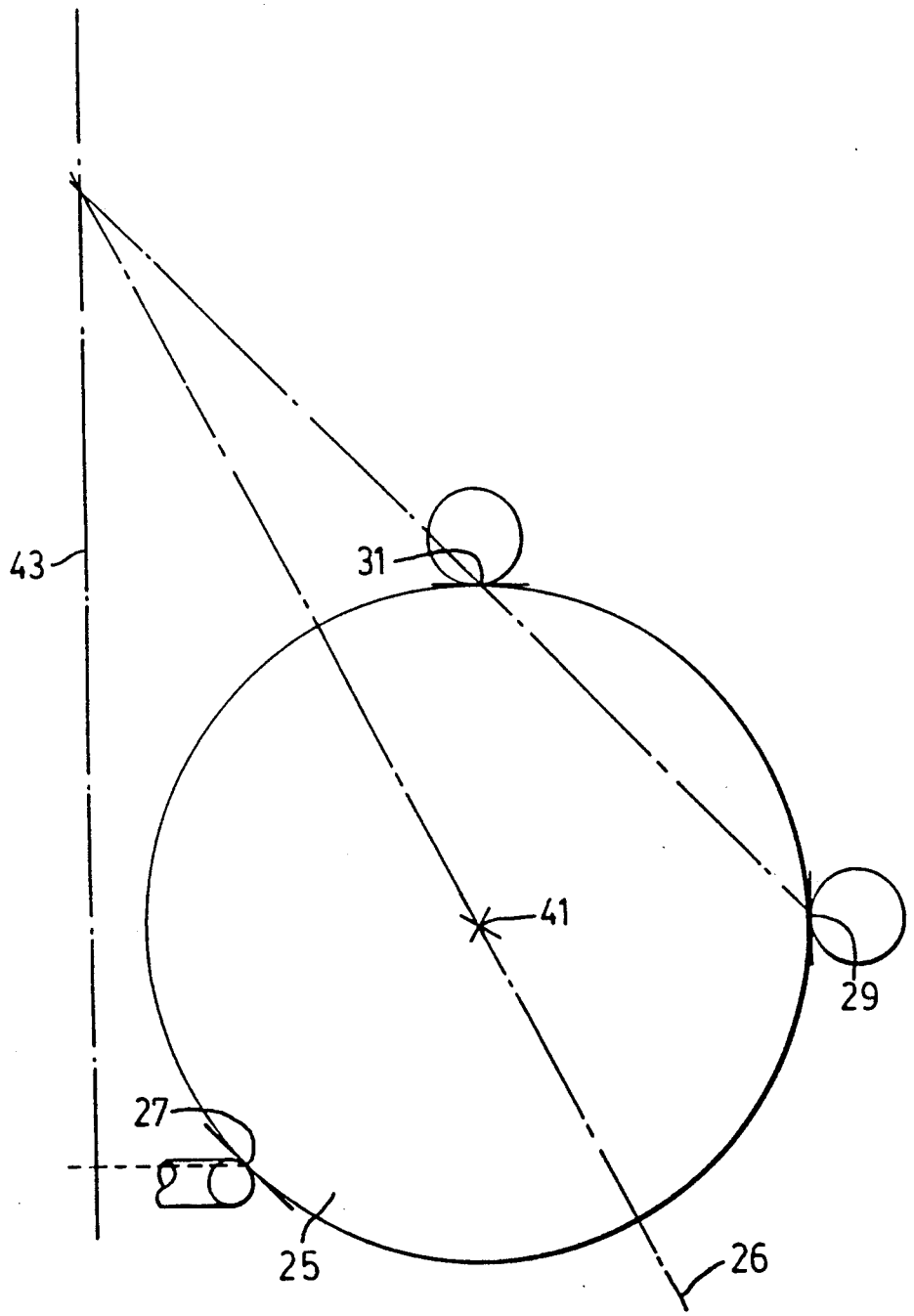
FIG. 4 is a geometric representation of a portion of the embodiment shown in FIG. 1.

The rotational motion of the drive shaft 13 about the first central axis of rotation is imparted by the second drive take off 23 to the massaging elements 25 causing each massaging element 25 to rotate about an axis of rotation which passes through said massaging element 25, hereinafter referred to as the second axis of rotation 26 (FIG. 4). When the massaging element 25 encounters a predetermined amount of resistance, slippage occurs between the massaging element 25 and the second drive take off 23.

The massaging elements 25 may be made of any material suitable for working a surface, such as wood or plastic and will preferrably be spherical. The massaging elements should be sufficiently strong to withstand normal stresses, but also should have a slightly textured surface to facilitate the transfer of a conditioning substance to the surface to be worked. It will be appreciated that while spherical massaging elements are preferred, other rotatable shapes may also be employed.

The opposite side of each massaging element 25 from the contact with second drive take off 23 comes into contact with two guide means 29, 31. Guide means 29, 31, are made of a resilient material such as hard rubber or plastic, and are fixed to the outer head 9. Since guide means 29, 31 are stationary, as drive take off 23 imparts rotation to each massaging element 25, the massaging elements 25 will tend to roll along the guide means 29, 31. In another embodiment of the invention, the guide means 29, 31 are integral with, and made of the same material as, the outer head 9. In this case, it would not be unusual to have the guide means 29, 31 coated with a resilient material. Thus, it will be possible for slippage to occur between the massaging elements 25 and the guide means 29, 31 upon a sufficient resistance being encountered. Again, such a resistance would be a predetermined amount below which no damage would be caused to the material being worked.

The second axis of rotation 26 (FIG. 4) passes through a centre of rotation of the massaging element 25, hereinafter referred to as the centre of rotation 41, and is angled inwardly towards the body portion 1 and into the inner head 11. An axis passing through the centre of two circles defined by the guide means 29, 31 is hereinafter referred to as the guide means central axis 43. A line through the points of contact between the massaging element 25 and each of the guide means 29, 31 intersects with the guide means central axis 43. A line drawn through this point of intersection and the centre of rotation 41 defines the second axis of rotation 26. In the preferred embodiment of the invention illustrated in the drawings, the first central axis of rotation and the guide means central axis 43 coincide.

It will be appreciated that the location of the guide means 29, 31 within the head 2 may be changed so as to alter the configuration of the points of contact between the guide means 29, 31 and the massaging element 25 causing the angle of the second axis of rotation 26 to change, possibly to an orientation parallel to the guide means central axis 43 or even outwardly away from the body portion 1 and out of the inner head 11. It will also be appreciated that slippage between any of the guide means 27, 29, 31 and the massaging element 25 may cause a change in the angle of the second axis of rotation 26.

A lower cap 33 is also shown which has a perimeter coupled with the perimeter of the inner head 11, allowing the lower cap 33 to rotate with the inner head 11. For each massaging element 25 there are corresponding circular-like openings 35, 37 in both the lower cap 33 and the inner head 11, respectively, through which each massaging element 25 extends. The inner head 11 and the lower cap 33, therefore, trap, but preferably not so as to come in contact with, the massaging element 25 between themselves and within the circular-like openings 35, 37 to prevent the massaging element 25 from escaping from within the head 2. However, there may be some frictional engagement between the massaging elements 25 and the circular-like openings 35, 37 as a result of the aforementioned slippage or in the event the rotation of the massaging elements 25 does not exactly match that of the inner head 11.

It can now be appreciated how the preferred embodiment of the present invention operates. When the drive means 3 is activated, causing the drive shaft 13 to rotate about the first central axis of rotation, the first drive take off 23 imparts rotation to the inner head 11 through the gearing mechanism associated with the first drive take off 23, causing the lower cap 33 and the massaging elements 25 to rotate about said first central axis of rotation with the inner head 11. Simultaneously, said rotation of the drive shaft 13 causes the second drive take off 23 to impart to each massaging element 25 a rotation about the second axis of rotation 26. When the massaging elements 25 are brought into contact with the surface to be worked, the invention delivers a massaging action to the said surface. Potential damage to the said surface is diminished due to the aforementioned slippage which can occur, when the massaging element 25 encounters a predetermined amount of resistance, between the drive shaft 13 and the rotating inner head 11, and between the drive shaft 13 and the massaging element 25.

The shape of the lower cap 33 and the size of the circular-like openings 35 may be manufactured so as to allow a greater or lesser surface exposure of the massaging elements 25 with the surface to be worked. The central region of the lower cap 33 which comes in contact with the surface to be worked may be manufactured to have any suitable shape for enhancing the massaging action of massaging elements 25. Two embodiments are seen in FIGS. 1 and 2, the former showing a spherical-like central region of lower cap 33 similar in shape to the massaging elements 25, and the latter showing a central region with a relatively flat surface.

The device may also be adapted to transport a conditioning substance from the receptacle 5 via a suitable transfer conduit 7 to a reservoir 39 (FIG. 2), the reservoir 39 being the space between the inner head 11 and the outer head 9. The massaging element 25 protrudes through the circular-like opening 37 (FIG. 3) in the inner head 11 into the reservoir 39, coming into contact with any conditioning substance present in reservoir 39. The rotational motions of the massaging element 25 and the inner head 11 cause the conditioning substance to be transferred by the massaging element 25 to the surface to be worked, thereby allowing the massaging elements 25 to deposit the conditioning substance onto the surface and to massage the surface simultaneously.

I claim:

1. A device for working a conditioning substance on a surface, the device comprising:

a body portion containing an activatable drive means;

a head, attached to the having an outer head and a rotatable inner head;

a drive shaft extending between drive means and the head and driven by the drive means;

a first drive take off for imparting rotation to the inner head about a first central axis of rotation passing through the inner head; and a second drive take off for imparting rotation to at least one spherical massaging element about a second axis of rotation passing through the massaging element by frictionally engaging the massaging element, each massaging element being located within the inner head and extending past an outer surface thereof;

wherein when the drive means is activated, each massaging element is simultaneously rotated in two manners, firstly, about the first central axis of rotation and secondly about the second axis of rotation, to work said surface upon said device being then applied.

2. A device according to claim 1 wherein the massaging element transfers a conditioning substance from within the head to the surface to be worked.

3. A device according to claim 1 wherein a gearing mechanism associated with the first drive take off is adapted to allow slippage to occur between the drive shaft and the rotating inner head.

4. A device according to claim 1 wherein, the second drive take off is adapted to allow slippage to occur between the drive shaft and the massaging element.

5. A device according to claim 3 wherein rotation of the inner head about a first central axis of rotation is effected by the first drive take off imparting rotation to at least one planet gear, such planet gear being engaged with the inner head and an outer gear ring mounted within the outer head, wherein the outer gear ring frictionally engages the outer head.

6. A device according to claim 1 wherein the outer head is fixed to the body portion and houses the inner head and the gearing mechanism associated with the first drive take off.

7. A device as claimed in any of claims 1 to 6 in which two guide means made of a resilient material are fixed to the outer head wherein the guide means are frictionally engaged with the massaging element to allow slippage to occur between the guide means and the massaging element upon the massaging element encountering a predetermined amount of resistance.

8. A device according to claim 1 wherein each second axis of rotation passes through a respective massaging element and, with no slippage occurring, said axis is angled towards the body portion inwardly into the inner head.

9. A device according to claim 1 wherein each second axis of rotation passes through a respective massaging element and, with no slippage occurring, is angled away from the body portion outwardly out of the inner head.

10. A device according to claim 1 wherein each second axis of rotation passes through a respective massaging element and, with no slippage occurring, is parallel to the first central axis of rotation.

11. A device according to claim 1 wherein the massaging element extends past the outer surface of the inner head into the space between the inner head and the outer head, said space being a reservoir adapted to contain the conditioning substance transported from the body portion, wherein the rotational motions of the massaging element and the inner head cause the conditioning substance to be transfered by the massaging element to the surface.

12. A device according to claim 1 wherein the body portion acts as a handle for the device.

13. A device according to claim 1 wherein the body portion has a space adapted to act as a receptacle for a conditioning substance from which the conditioning substance may be transported to said reservoir.

14. An improved process for massaging a conditioning substance on a surface in which the improvement comprises simultaneously rotating a massaging element in two manners with the aid of a device comprising:

a body portion containing an activatable drive means;

a head, attached to the body portion, the head having an outer head and a rotatable inner head;

a drive shaft extending between drive means and the head and driven by the drive means;

a first drive take off for imparting rotation to the inner head about a first central axis of rotation passing through the inner head; and a second drive take off for imparting rotation to at least one spherical massaging element about a second axis of rotation passing through the massaging element by frictionally engaging the massaging element, each massaging element being located within the inner head and extending past an outer surface thereof;

wherein when the drive means is activated, each massaging element is simultaneously rotated in two manners, firstly, about the first central axis of rotation and secondly about the second axis of rotation, to work said surface upon said device being then applied.

* * * * *